United States Patent [19]

Leoncavallo et al.

[11] Patent Number: 4,771,900

[45] Date of Patent: Sep. 20, 1988

[54] STORAGE RACK FOR BOX-LIKE CONTAINER

[75] Inventors: Richard A. Leoncavallo, Pittsford; Gregory R. Phillips, Penfield, both of N.Y.

[73] Assignee: Nalge Company, Rochester, N.Y.

[21] Appl. No.: 36,299

[22] Filed: Apr. 9, 1987

[51] Int. Cl.[4] ..... A47G 29/00

[52] U.S. Cl. ..... 211/84; 211/128

[58] Field of Search ..... 211/84, 87, 71, 10, 211/11, 76, 82, 83, 88, 126, 113, 128

[56] References Cited

U.S. PATENT DOCUMENTS

| | | | |
|---|---|---|---|
| 470,050 | 3/1892 | Jewell | 211/42 X |
| 549,212 | 11/1895 | Roberts . | |
| 764,299 | 7/1904 | Marsh | 211/10 |
| 1,217,973 | 3/1917 | Mann | 211/10 X |
| 1,356,620 | 10/1920 | Grubb | 211/82 X |
| 1,702,361 | 2/1929 | Olinger | 211/84 X |
| 2,525,551 | 10/1950 | Keith . | |
| 3,028,015 | 4/1962 | Williams | 211/83 |
| 3,760,952 | 9/1973 | White . | |
| 3,902,603 | 9/1975 | Wilson . | |

*Primary Examiner*—J. Franklin Foss
*Assistant Examiner*—Sarah A. Lechok Eley
*Attorney, Agent, or Firm*—Marjama & Pincelli

[57] ABSTRACT

A storage rack for holding a plurality of substantially box-like containers. The rack is provided with a plurality of independent locking members, one associated with a single box-like container. The locking member may be rotated in and out of a locking position.

13 Claims, 7 Drawing Sheets

STORAGE RACK FOR BOX-LIKE CONTAINER

BACKGROUND OF THE INVENTION

The present invention is directed to storage racks and more particularly to a storage rack for holding a plurality of substantially box-like storage containers one above the other capable of being used in a cryogenic environment.

In medical, research and biological laboratories it is often necessary to store biological or other type samples at ultra low temperatures, temperatures below −20° Centigrade, or in a cryogenic environment, i.e., temperatures below −100° Centigrade. Typically Biological samples are placed in a cryogenic vial, a plurality of which are placed in a storage container. A plurality of storage containers are then placed in a rack which is placed in a mechanical freezer or vessel containing a cryogenic medium such as liquid nitrogen vessel containing liquid nitrogen preferably have a working temperature at the opening at −150° Centigrade or below in order to assure the viability of frozen cells for long periods of time. Quite often it is necessary to retrieve only vials from a single storage box from the plurality of storage boxes placed in the rack. In order to protect the viability of the samples not used it is important to return the rack to the cryogenic environment as quickly as possible. While it may not appear that a sample removed from a cryogenic environment and held briefly at an ambient temperature has warmed, every time a sample has been brought to warmer environments even briefly, it experiences a change in temperature. Thus when removing a sample from cold storage, care should be taken to avoid exposure of other samples to the warmer temperature. Repeated warming and recooling of stored samples will reduce the viable storage time. Certain samples are extremely sensitive to temperature change, even of short duration. In the prior art, a long rod is used to keep all of the storage containers within the rack. When the rack is removed from the cryogenic environment the rod is pulled out allowing access to all of the storage containers. However, if the rack is inadvertently tipped or jarred there is high risk that a storage container will fall from the rack thereby potentially damaging the samples.

Applicants have invented an improved rack for holding a plurality of storage containers having means for independently locking and maintaining each of the containers within the rack which allows quick and easy access thereto.

SUMMARY OF THE INVENTION

A storage rack for holding plurality of substantially box-like containers. A plurality of independent locking members are provided, one being associated with each storage compartmental area. The locking member is pivotably mounted to the rack such that it may be rotated to a first position for maintaining the container within the rack and a second position for allowing easy access to the storage compartmental area.

DETAILED DESCRIPTION OF THE INVENTION

Figure 1:
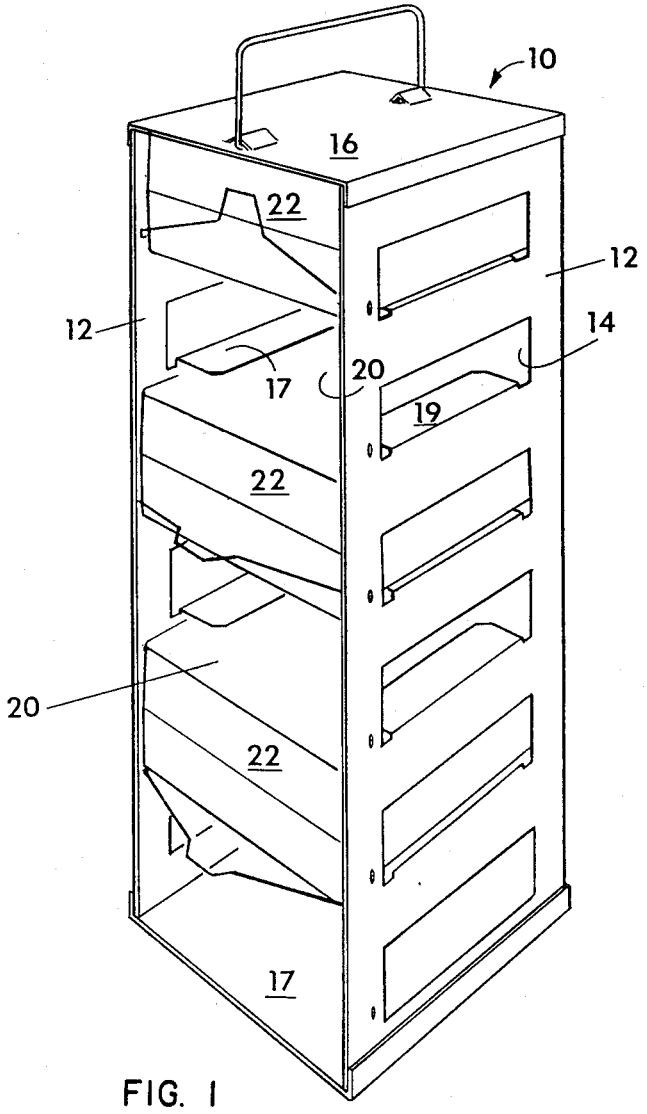
FIG. 1 illustrates a perspective view of a rack made in accordance with the present invention.
Figure 2:
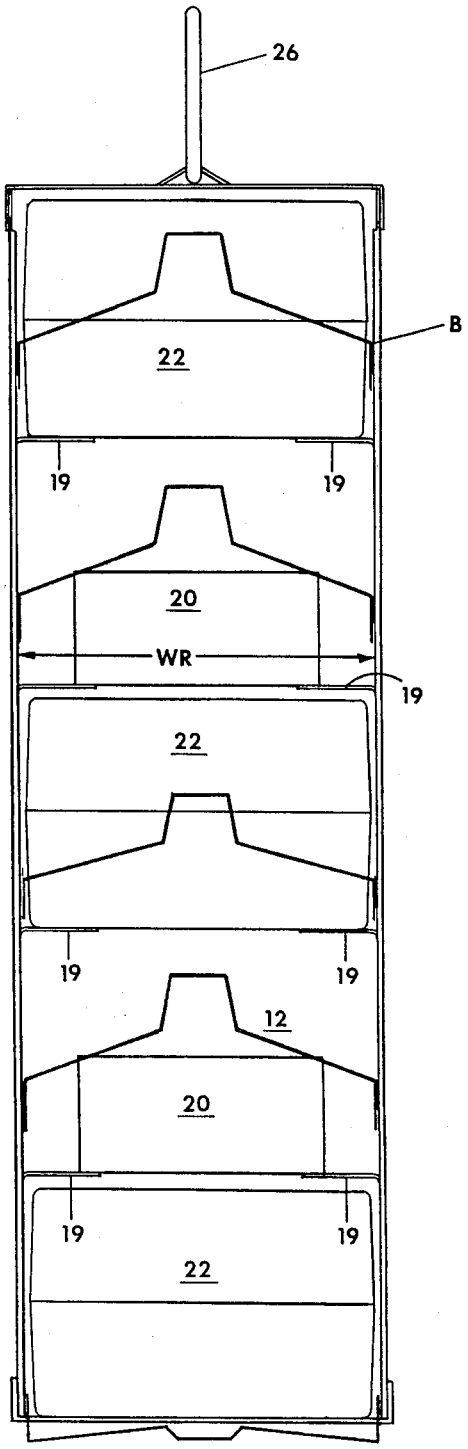
FIG. 2 is a front elevational view of the invention of FIG. 1.
Figure 3:
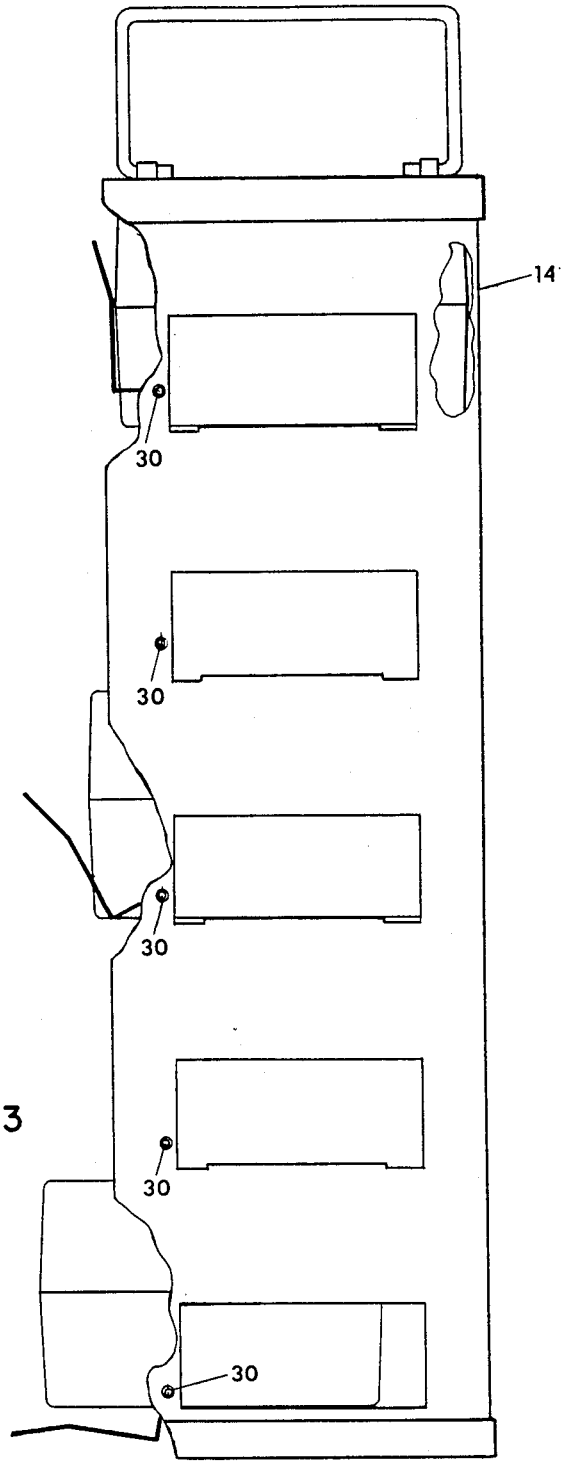
FIG. 3 is a side elevational view of the rack of FIG. 1.
Figure 7:
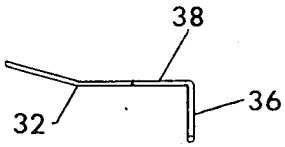
FIG. 7 is aa side elevational view of the locking member illustrated in FIG. 4.
Figure 4:
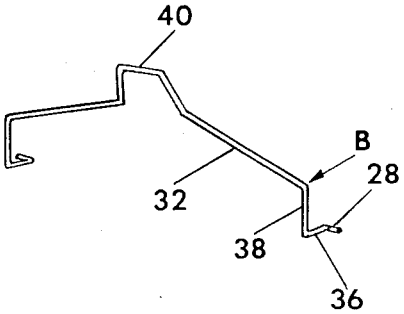
FIG. 4 is a perspective view of the locking member illustrated in FIG. 1.
Figure 6:
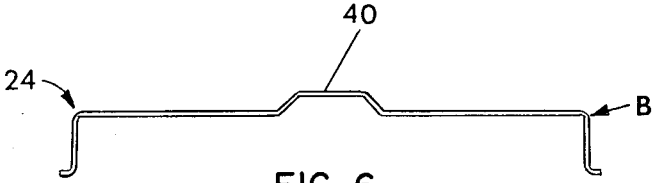
FIG. 6 is a top elevational view of the locking member of FIG. 4.
Figure 5:
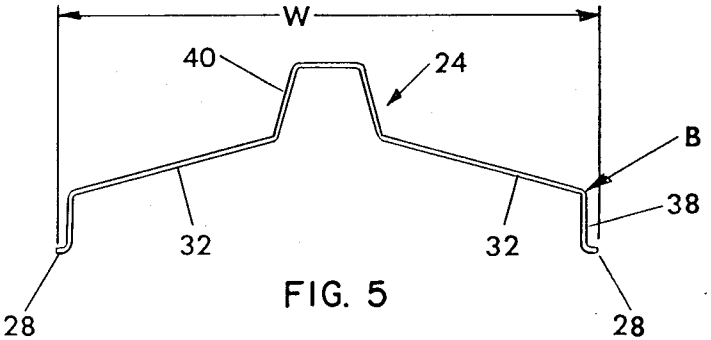
FIG. 5 is front elevational view of the locking member of FIG. 4.

Referring to FIGS. 1, 2 and 3 there is illustrated a rack 10 made in accordance with the present invention. The rack 10 has a pair of oppositely disposed side walls 12 and a back wall 14 connecting side walls 12. The rack is provided with a top portion 16 and a bottom portion 17. A plurality of shelves 19 extend from side walls 12. The shelves 19 in conjunction with side walls 12, back wall 14, top portion 16 and bottom portion 17 form a plurality of compartmental areas 20 one above the other, each capable of receiving a substantially box-like container 22. In the particular embodiment illustrated a pair of shelves 19 are provided for supporting each container 22. The shelves 19 may extend any desired distance across rack 10, it is only necessary that they support container 22, or if desired a single shelf may be provided for supporting container 22.

Associated with each compartmental area is a locking member 24. In the particular embodiment illustrated there are five compartmental areas 20, however, the rack 20 may be provided with any desired number of compartmental areas. The top, central and bottom compartmental areas 20 each have a substantially box-like 22 container therein which is capable of holding a sample to be stored, for example a biological cell culture. The container 22 may be of a conventional construction as is presently used in the art used to hold samples. The second and forth compartmental areas 20, starting from the top 16, are empty. In the top compartmental area 20, container 22 is illustrated in its fully seated position within the rack 10 (see FIGS. 3 and 8) and the locking member 24 is in its closed position. For the purposes of this invention the fully seated position is that position wherein the container 22 placed as far back its the rack 10 as possible. In the empty compartmental area 20 directly below the top compartmental area locking member 24 is shown in the fully closed position. In the central position there is illustrated a box-like container 22 which has been moved forward and locking member 24 preventing the box-like container 22 from falling out. In the compartmental area 20 directly below the cental compartmental area there is illustrated a locking member 24 in also the fully closed position. The bottom compartmental area 20 lustrates a locking member 24 in its open position whereby a box-like container 22 can be easily placed therein or removed therefrom.

In the particular embodiments illustrated the top 16 of rack 10 is provided with a handle 26 for lifting the rack 10 and positioning the rack 10 within a cryogenic environment by any conventional means. The configuration of the handle may be any shape desired.

Referring to FIGS. 4, 5, 6 and 7 there is illustrated locking member 24 made in accordance with the present invention. Locking member 24 has a pair of terminal end 28 which are mounted to the side walls 12 of rack 10 through opening 30 therein (see FIG. 3). The opening 30 is designed to be of a size sufficient to allow easy entrance and removal of the terminal ends 28 yet not too large as to provide an excessive amount of movement of the terminal ends 28 therein. In the particular embodiment illustrated the openings 30 have a diameter of approximately 0.070 inches and the terminal ends 28 have a diameter of approximately 0.036 inches. In the preferred embodiment locking member 24 is made of a metal wire having a substantially circular cross-section. In the particular embodiment illustrated the locking member 24 is made of stainless steel. The locking member 24 has a front support portion 32 which engages the front of box-like container 22 for preventing the container 22 from coming out of the compartmental area 20 when locking member 24 is placed in a locking position. The front portion 32 is connected to terminal ends 28 by side portions 34 connected to terminal ends 38. In the particular embodiment illustrated the side portions comprise a first leg 36 extending from the terminal end and a second leg 38 which is disposed at substantially 90° to first leg 36 and extends substantially parallel to the plane in which front portion 32 lies.

Figure 8:
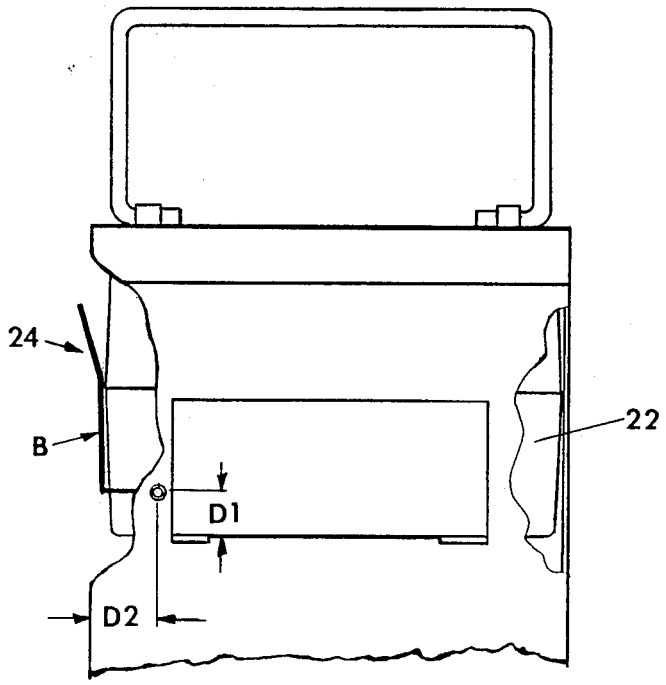
FIG. 8 is a fragmentary view of FIG. 3 illustrating the top compartmental area within the locking member in its normally closed position.
Figure 9:
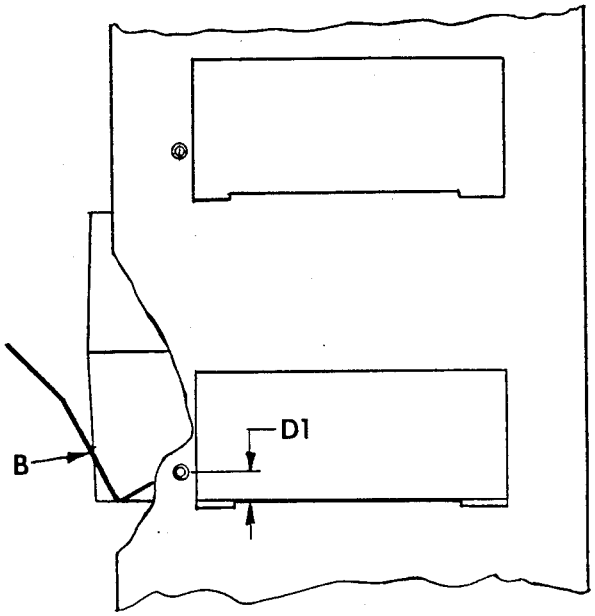
FIG. 9 is a fragmentary enlarged view of FIG. 3 illustrating the central compartmental area with the locking member preventing the container from coming out.

Referring to FIG. 8, the locking member 24 is shown in its closed position. When the locking member is in the closed position it will prevent box-like container 22 from simply sliding out of the compartmental area 20 unless the locking member has been moved past the locking position illustrated in FIG. 9. The locking member 24 starting at point B engages the front portion of container 22 and prevents container 22 from inadvertently sliding out of compartmental area 20. As shown in FIG. 9 if a box-like container slides forward it would be stopped from any further movement once the locking member reaches its locking or equilibrium position. When the locking member is in the locking position, the sum of the horizontal and vertical forces is zero. The spring forces of the locking member and/or weight of the container 22 provides a sufficient force to prevent the locking member from rotating open any further. The locking member is maintained in the closed or open position by the spring forces being applied at the opening 30. The locking member is designed such that the width W of locking member 24 (see FIG. 5) is greater than the width WR between the openings 30 (see FIG. 2) inside walls 12 so as to provide a spring force between the locking member 24 and rack 10. This spring force will cause the locking member to stay in the position it is rotated to by the operator. The amount of spring force provided is sufficient to allow easy rotation of locking member 24, yet provide sufficient force that the locking member will not be easily moved by movement of the rack or being jarred. In the particular embodiment illustrated the distance WR is approximately 3.5 inches (8.89 cm) and the width W of locking member 24 is approximately 3.75 inches (9.525 cm). Accordingly there would be a tension between the locking member 24 and the rack 10 which will cause the locking member to be maintained the position which it is placed by the operator. The width W of locking member 24 is also such that it will accommodate the width WB of the container (see FIG. 2) within the compartmental area 20.

The entire operation of removing the rack from a cryogenic environment, removing a container, removing an ampule from the container and then returning the entire assembly back to the cryogenic environment can be accomplished with the use of a single hand quickly with minimal risk of jarring the rack or dislodge boxes not used. Applicants have found that this procedure can be accomplished in about 30 seconds as opposed to about 45 seconds of a rack of the prior art which utilizes a rod. This is assuming that no unusual difficulty is experienced in returning the rod to the rack which commonly occurs in aligning the rod with the holes in the rack it must pass through. As previously mentioned this time can be of significant importance in maintaining the availability of samples.

While applicants have found that opening 30 need not be provided with any other means for maintaining the locking member 24 in any position which is moved to the opening 36 may be provided with a detent system (not shown) for providing positive locking positions of the locking member 24. For example, opening 30 could be provided with an indented portion for receiving the leg 38 of locking member 24 when in the locking position. However, applicants have found the spring force of the locking member 24 is sufficient for maintaining the locking member 24 in the position it is left by the operator.

Figure 10:
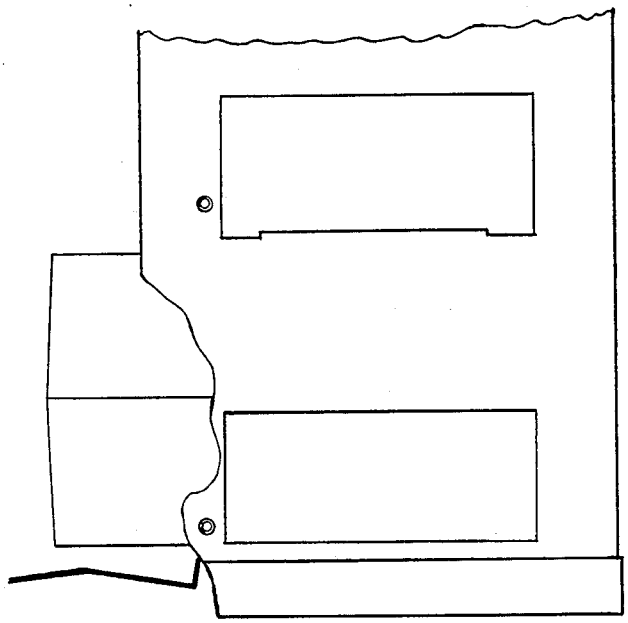
FIG. 10 is a fragmentary view of FIG. 3 illustrating the bottom compartmental area with the locking member in its fully opened position.

In the particular embodiment illustrated the side portion comprises a first leg 36 and second leg 38. However, if desired the side portion may be a single member extending from terminal end 28 to point B where it meets front portions 32. An important aspect of the present invention is that the distance from terminal end 28 to point B is such that it will allow clearing of the substantially box-like member in the fully opened position as illustrated in FIG. 10 yet will provide the locking capabilities as illustrated in FIG. 9.

In the particular embodiment illustrated front portion 32 of locking member 24 is provided with a gripping portion 40 which extends away from the container 22 so as to provide means for manually gripping the locking member 24. In the practice of the present invention a substantially box-like container is initially placed within a compartmental area 20 by simply sliding a container 22 on shelf 18. After the container 22 has been fully seated the locking member is rotated upward to the position as illustrated in FIG. 1. It is only sufficient that the locking member 24 be rotated up past the locking position illustrated in FIG. 9. Once the locking member is rotated past this position vertically upwards the container will be stopped from simply sliding of compartmental area 20. In order to remove the container the locking member 24 is rotated below the locking position to a point out of the path of the container. The container is then just simply pulled out. It can be seen that this operation can be done very quickly and easily by the use of a single hand.

In order to provide the appropriate locking position for locking member 24 as illustrated in FIG. 9 it is important that the opening be positioned at a distance D1 above the shelf such that the locking member will prevent further movement outward of the container and that the container will not simply jump or slide over the locking member. In the particular embodiment illustrated D1 is at least 0.25 inches (0.635 cm) and preferably of at least 0.375 inches (0.95 cm). the particular embodiment illustrated D1 is about 0.4 inches (1.016 cm). The opening 30 is also preferably positioned a distance D2 behind the front plane of the container 20 when in the fully seated position. In the particular embodiment illustrated the distance D2 is at least 0.25 inches (0.635 cm), preferably of at least about 0.375 inches (0.95 cm). In the particular embodiment, D2 is about 0.4 inches (1.016 cm). D1 is preferably equal to D2 as illustrated. D1 and D2 are large enough to prevent accidental falling out of the container, yet is preferably not too large as to require an excessive amount of swing to rotate locking member from the open to locked position.

Various modifications can be made to the present invention without departing from the scope of the present invention. For example, in the preferred embodiment the locking member 24 is a wire having substantially circular cross-sectional shape, however, the present invention is not so limited. The locking member may take other forms, for example, locking member may take the form of a narrow flat strip.

What is claimed is:

1. A storage rack for holding a plurality of substantially box-like containers, having a plurality of storage compartmental areas one above the other, each of said compartmental areas having a single pair of oppositely disposed sidewalls, each of said compartmental areas being capable of receiving and holding a substantially box-like storage container, characterized by a plurality of independent locking members, one locking member being associated with each of said storage compartmental areas, each of said locking members having a pair of terminal ends rotatably mounted to openings in said sidewalls, wherein said openings where said terminal ends are mounted to said rack is positioned behind the front of said substantially box-like container when said container is in the fully seated position in said compartmental area, a front support portion for placement in front of said container, and a pair of side portions connecting said front portion to said terminal ends respectively, said locking member having means for holding said locking member in a stationary position, said locking member having a configuration such that when placed in a first position it maintains and holds said container within said storage compartmental area and when placed in the second position allows entrance or removal of said substantially box-like storage container, said means for holding said locking member in a stationary position comprises at least in part a spring force generated by the configuration of said locking member when mounted to said rack.

2. A storage rack according to claim 1 wherein said side portion comprises a first leg having a length at least equal to or greater than the distance said opening is spaced from the front of said container when said container is in the fully seated position within said compartmental area and a second leg which is disposed at substantially 90° to said first leg and extending substantially parallel to the plane said front support portion lies within.

3. A storage rack according to claim 1 wherein said front support portion further comprises a gripping portion which is angled away from said container so as to provide means for holding said locking member for rotating of said locking member.

4. A storage rack according to claim 1 wherein the distance from a point where said terminal ends are mounted to said rack to where said side portion meets said front support portion is a length such that when said front portion is moved from said first position to said second position said locking member allows access of a container within said compartmental area.

5. A storage rack according to claim 1 wherein said means for holding said locking member in a stationary position comprises an indented portion in said opening for receiving said terminal ends.

6. A storage rack for holding a plurality of substantially box-like containers having a plurality of storage compartmental areas one above the other, each having a support shelf, each of said compartmental areas having a single pair of oppositely disposed sidewalls, each of said compartmental areas being capable of receiving and holding a substantially box-like storage container, characterized by a plurality of independent locking members, one locking member being associated with each of said storage compartmental areas, each of said locking members having a pair of terminal ends rotatably mounted to openings in said sidewalls at a point above the support shelf associated with said compartmental area, wherein said openings where said terminal ends are mounted to said rack is positioned behind the front of said substantially box-like container when said container is in the fully seated position in said compartmental area, a front support portion for placement in front of said container, and a pair of side portions connecting said front portion to said terminal ends respectively, said locking member having means for holding said locking member in a stationary position, said locking member having a configuration such that when it is placed in a first position it maintains and holds said container within said storage compartmental area and when placed in the second position said locking member allows entrance or removal of said substantially box-like storage container within said compartmental area, said means for holding said locking member in a stationary position comprises at least in part a spring force generated by the configuration of said locking member when mounted to said rack.

7. A storage rack according to claim 6 wherein said side portion comprises a first leg having a length at least equal to or greater than the distance said opening is spaced from the front of said container when said container is in the fully seated position within said compartmental area and a second leg which is disposed at substantially 90° to said first leg and extending substantially parallel to the plane said front support portion lies within.

8. A storage rack according to claim 6 wherein said front support portion further comprises a gripping portion which is angled away from said container so as to provide means for holding said locking member for rotating of said locking member.

9. A storage rack according to claim 6 wherein the distance from said point said terminal ends are mounted to said rack to where said side portion meets said front support portion is a length such that when said front portion is moved from said first position to said second position said locking member allows access of a container within said compartmental area.

10. A storage rack according to claim 6 wherein said terminal ends are mounted to side rack is positioned above said support shelf.

11. A storage rack according to claim 8 wherein said terminal ends are mounted to said rack is positioned above said support shelf.

12. A storage rack according to claim 11 wherein the distance said terminal ends are mounted above said support shelf is substantially equal to the distance said terminal ends are mounted behind the front of said substantially box-like container when said container is in the fully seated position in said compartmental area.

13. A storage rack according to claim 6 wherein said means for holding said locking member in a stationary position comprises an indented portion in said opening for receiving said terminal ends.

* * * * *